United States Patent [19]

Densen

[11] Patent Number: 4,953,779

[45] Date of Patent: Sep. 4, 1990

[54] REVERSIBLE FOLDABLE CONTAINER AND CLOSURE THEREFOR

[76] Inventor: Mark S. Densen, 18 Blackburn Pl., Summit, N.J. 07901

[21] Appl. No.: 203,068

[22] Filed: Jun. 6, 1988

Related U.S. Application Data

[63] Continuation of Ser. No. 104,354, Oct. 5, 1987, abandoned, which is a continuation of Ser. No. 888,365, Jul. 23, 1986, abandoned, which is a continuation of Ser. No. 674,691, Nov. 26, 1984, abandoned.

[51] Int. Cl.[5] ..... B65D 5/42

[52] U.S. Cl. ..... 229/23 R; 40/312; 206/459; 229/922; 229/DIG. 4

[58] Field of Search ..... 206/457, 459; 229/23 R, 229/23 BT, DIG. 4, 922; 40/312

[56] References Cited

U.S. PATENT DOCUMENTS

| | | | |
|---|---|---|---|
| 1,758,511 | 5/1930 | Gross | 229/922 |
| 2,107,347 | 2/1938 | Sloane et al. | 150/105 |
| 2,536,990 | 1/1951 | Williamson | 220/922 |
| 2,604,984 | 7/1952 | Apgar | 229/DIG. 4 |
| 3,108,627 | 10/1963 | Tatelman | 150/103 |
| 3,373,922 | 3/1968 | Watts | 229/922 |
| 3,829,008 | 8/1974 | Murray et al. | 229/87 R |
| 4,169,553 | 10/1979 | Cain | 229/919 |
| 4,210,250 | 7/1980 | Yale | 229/73 |
| 4,365,738 | 12/1982 | Densen | 206/459 |
| 4,444,354 | 4/1984 | Staelgraeve | 206/459 |

*Primary Examiner*—Gary Elkins
*Attorney, Agent, or Firm*—Arthur T. Fattibene

[57] ABSTRACT

A readily foldable reversible container formed of a blank sheet material having predetermined foldlines about which the blank may be folded to define an erected container or box, and which blank is provided with indicia formed on the opposed surfaces of the blank to define a predetermined design or pattern whereby the blank can be reversely folded about the respective foldlines so that the predetermined design or pattern on the opposed surfaces of the blank can be selectively positioned either on the inside or outside of the erected container or box depending upon which direction the blank is folded.

2 Claims, 2 Drawing Sheets

REVERSIBLE FOLDABLE CONTAINER AND CLOSURE THEREFOR

This application is a continuation of application Ser. No. 07/104,354 filed Oct. 5, 1987 now abandoned, which was a continuation of Ser. No. 888,365 filed July 23, 1986 now abandoned, which was a continuation of Ser. No. 674,961 filed Nov. 26, 1984 now abandoned.

FIELD OF INVENTION

This invention relates generally to the art of readily knock-down type containers or boxes which are formed of blanks of sheet material having predetermined fold lines about which the blank may be folded to define an erected box or container.

RELATED APPLICATIONS OR PATENTS

This application is related to improvements in the type of container or box construction disclosed in my application Ser. No. 186,906 filed Sept. 15, 1980, and now U.S. Letters Pat. No. 3,365,738 granted on Dec. 28, 1982.

PROBLEM AND/OR PRIOR ART

Foldable boxes formed of precut and/or prescored blanks of sheet material are readily known, and there exists many known constructions by which such boxes and/or containers can be constructed, as evidenced by my above identified patent and of the known art cited therein. However, such containers and/or boxes are generally formed of cardboard and/or corrugated blanks of cardboard or paper sheet material which are devoid of any decorative appearance and/or are provided with limited design appeal. Also, such known knock-down containers formed of blank sheet material are scored or formed with predetermined foldlines that permit the blanks so formed to be folded in one direction only. For this reason, one surface of the blank always defined the exterior surface of an erected box or container, and the other side always defined the inner surface of the erected box or container.

OBJECTS

An object of this invention is to provide an improved box construction formed of readily foldable sheet material having predetermined foldlines about which the folds can be reversely folded so as to selectively have either surface of the blank define the inside or outside surface of the erected container and/or cover therefor.

Another object is to provide the blanks from which a container is erected with indicia of a distinct pattern or design formed or placed on the opposed surfaces of the blank so that when folded, the respective indicia is disposed either on the interior or exterior surfaces of the erected box or container, depending upon the direction of fold.

SUMMARY OF THE INVENTION

The foregoing objects and other features and advantages are attained by providing the preformed blanks from which the knock-down containers are formed with predetermined indicia or patterns applied to the opposed surfaces of the blank, and providing the blank with predeterminedly placed foldlines about which the panels defined thereby can be reversely folded in one direction or the other as desired. The arrangement is such that such blank can be folded so that the user can form or erect the container so that either surface of the blank can define the outer side of the erected container and the outer surface can define the inner side of the erected container. In one form of the invention, the respective surface patterns or indicia can be imprinted directly onto the opposed surfaces of the blank, and in another form of the invention, the indicia is applied as a layer to the opposed surfaces of the blank.

FEATURES

A feature of this invention resides in the forming of a blank of sheet material with foldlines about which the blank is folded to define an erected container that allows the blank to be folded in different directions.

Another feature resides in providing a design indicia to the opposed surfaces of the blank so that in the folded position of the blank, the indicia disposed on one surface of the blank defines the inner side of the erected container and the indicia on the other surface defines the outer side of the container, and which blank can be reversely folded to reverse the position of the indicia on the inner and outer sides of the erected container.

Other features and advantages will become more readily apparent when considered in view of the drawings in which.

DETAILED DESCRIPTION

Figure 1:
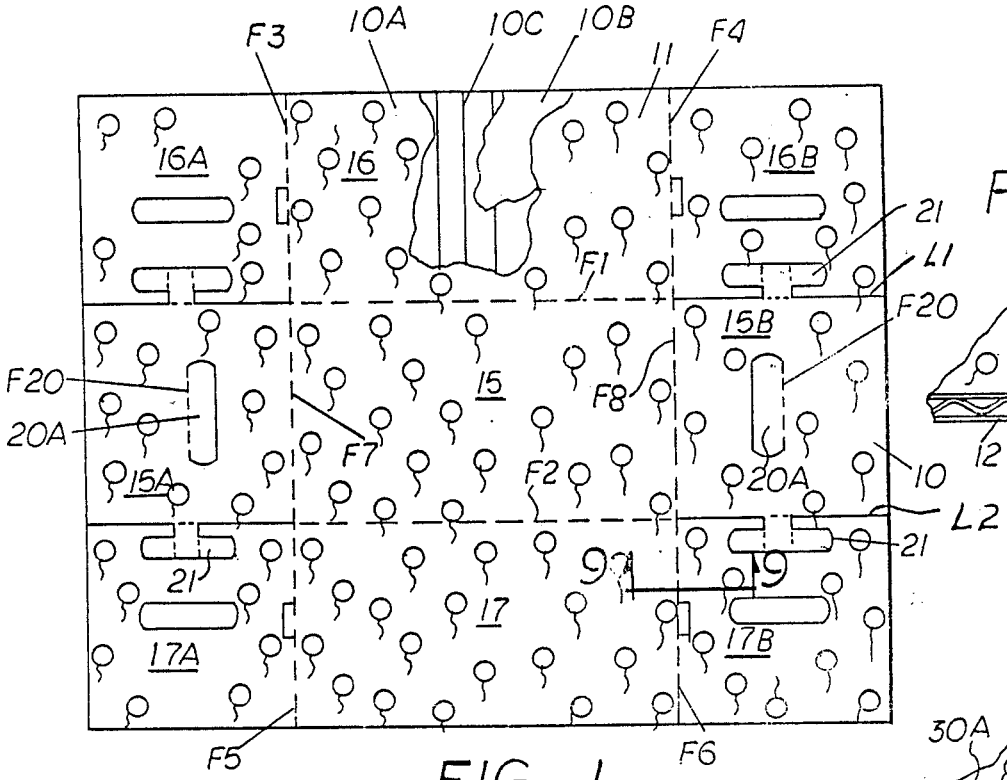
FIG. 1 is a plan view of a preformed blank from which a container is erected and which embodies the present invention.
Figure 7:
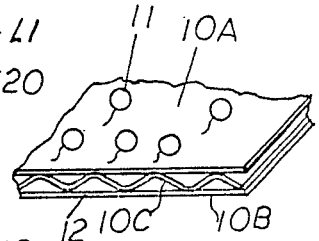
FIG. 7 is a fragmentary detail view of a detail of construction.
Figure 2:
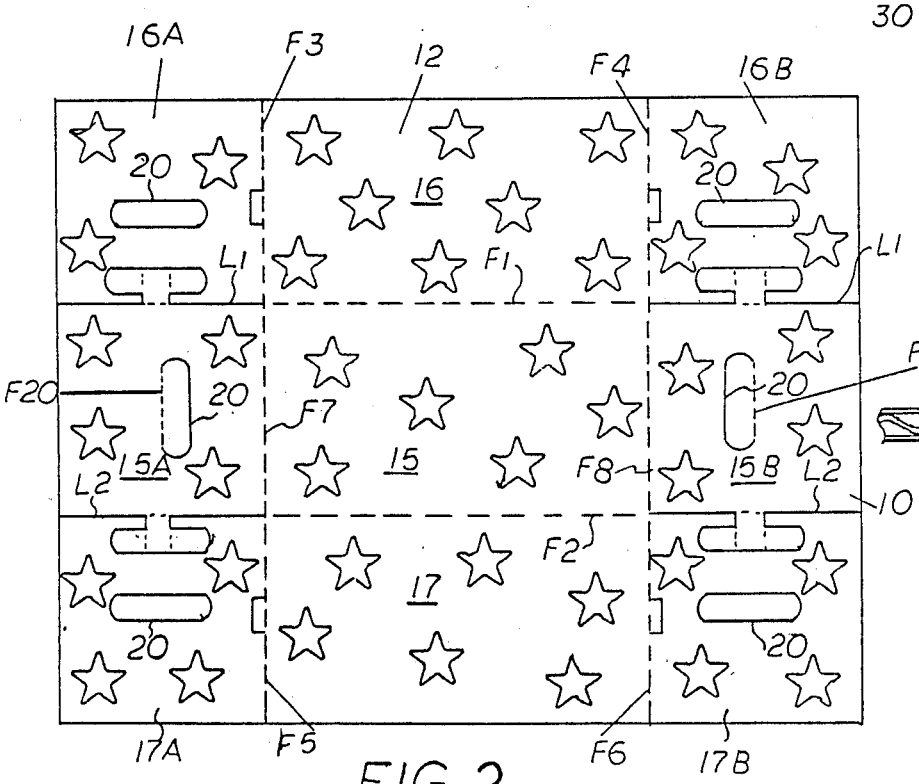
FIG. 2 is a plan view of a preformed blank shown in FIG. 1, but illustrating the other side of said blank.

Referring to the drawings, there is shown a readily foldable knock-down type of container which is formed of a blank of sheet material 10, which embodies the present invention. Referring specifically to FIGS. 1 and 2, the blank of sheet material 10 is formed of readily foldable material such as cardboard, corrugated board and the like. In the illustrated embodiment, a corrugated type board is utilized. Such corrugated board is formed of a pair of spaced apart sheets of craft type paper 10A and 10B which has sandwiched therebetween a corrugated or unulating sheet 10C. It will be understood that the blank 10 is formed as shown in FIG. 7.

In accordance with this invention, the opposed surfaces 11 and 12 of the blank 10 are provided with suitable indicia means to define a predetermined pattern or design. In the illustrated embodiment, the indicia means on side or surface 11 may be a polka dot type configuration. The other surface 12 of the blank 10 is formed with other indicia means, such as stars as illustrated. However, it will be understood that the other desired indicia means may be used without departing from the spirit of this disclosure. The specific indicia means disclosed are for purposes of illustration only. In the embodiment of FIG. 7, the indicia means formed disclosed are for purposes of illustration only. In the embodiment of FIG. 7, the indicia means formed on surfaces 11 and 12 may be imprinted or formed directly into the respective surfaces of the blank 10.

Referring to FIGS. 1 and 2, the blank 10 is die cut and scored to define a plurality of panels which, in the erected position of the blank, defines a bottom panel 15 having connected opposed side panels 16 and 17 adapted to be folded relative to the bottom panel about foldlines $F_1$ and $F_2$ respectively. Connected to each side panel 16 and 17 are inner end paensl 16A, 16B, 17A, 17B respectively, which are foldable about foldlines $F_3$, $F_4$ and $F_5$, $F_6$ respectively.

Connected to the bottom panel 15 about foldlines $F_7$ and $F_8$ are outer end panels 15A, 15B which are separated by a due cut line L1 and L2 from the adjacent inner end panels 16A, 17A and 16B, 17B.

Figure 3:
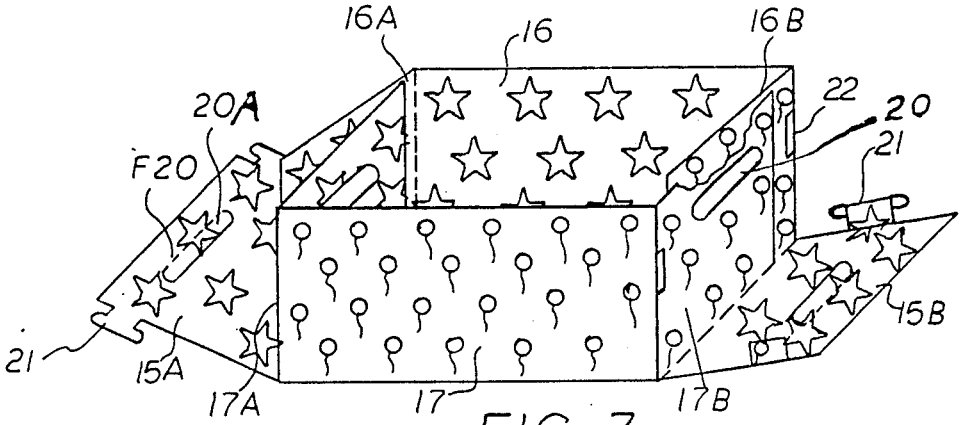
FIG. 3 is a perspective view of a container formed from the blank of FIGS. 1 and 2 shown in partially erected position.

In accordance with this invention, the respective foldlines $F_1$ to $F_8$ are formed so that the respective panels defined thereby can be readily folded in either direction relative to its adjacent panel. For example, by folding the respective panels about their respective foldlines $F_1$ to $F_8$ as shown in FIG. 3, the polka dot indicia defines the outer pattern of the erected container and the star indicia defines the interior pattern of this container. By reversing the fold of the panels about the respective foldlines, the pattern can be reversed, i.e., the star pattern becomes the external pattern and the polka dot pattern becomes the inner pattern. Also shown are the hand openings 20 blanked out of the inner end forming panels 16A, 16B and 17A, 17B which in the folded portion of the container are disposed in alignment; similar to that described in my above noted patent; and secured in the assembled position by a locking flap 20A which is folded about its respective foldline $F_{20}$. Locking T-tabs 21 are blanked out of the inner end panels which are adapted to mate with complimentary tab opening 22 to secure the panels in the erected position.

Figure 9:
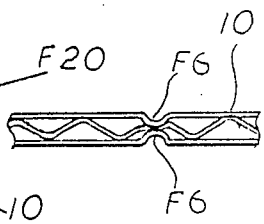
FIG. 9 is a section view of a detail of construction.

FIG. 9 illustrates a detail of a foldline construction. As shown, a foldline is defined by scoring both sides of the blank to define a crease or fold line, e.g., $F_6$ on both sides of the blank about which the panel defined thereby can be readily folded in either direction. While the opposed scoring as shown in FIG. 9

Figure 8:
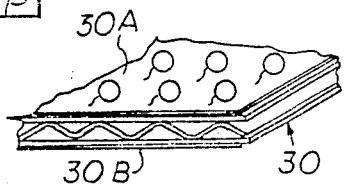
FIG. 8 is a fragmentary detail view of a modified form of construction.

FIG. 8 illustrates a modified form of the invention. In this form of the invention, the blank 30, which is illustrated as being corrugated similar to that described in FIG. 7, is provided with a surface layer 30A and 30B which is laminated by suitable adhesive to the respective surface of the blank 30. The exposed side of the respective surface layers 30A and 30B are provided with suitable indicia means to define a predetermined pattern as hereinbefore described. In all other respects, the construction of the blank 30 is similar to that hereinbefore described.

Figure 4:
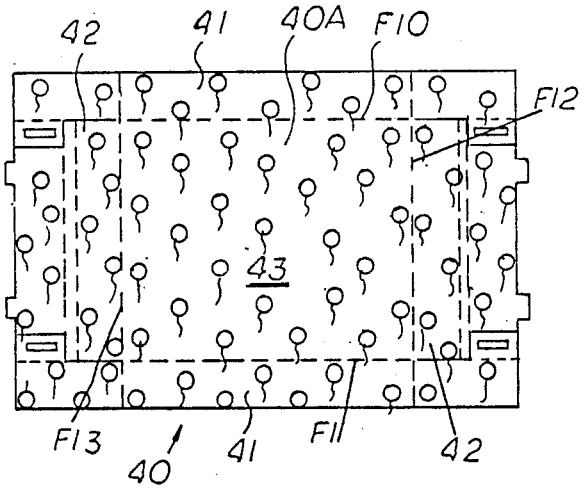
FIG. 4 is a plan view of preformed blank embodying the invention from which a container top is formed.
Figure 5:
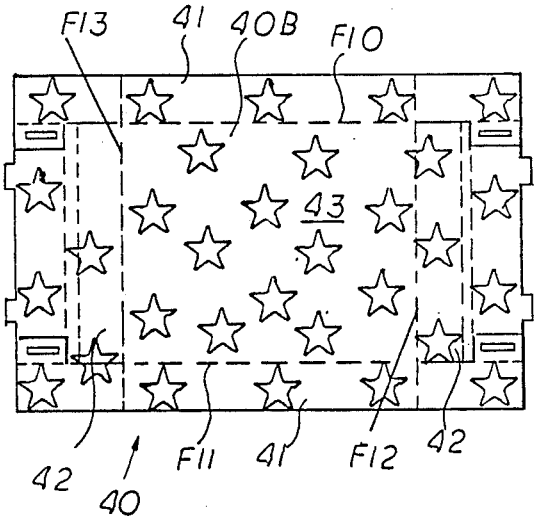
FIG. 5 is a plan view of the blank of FIG. 4 illustrating the other surface of the blank.
Figure 6:
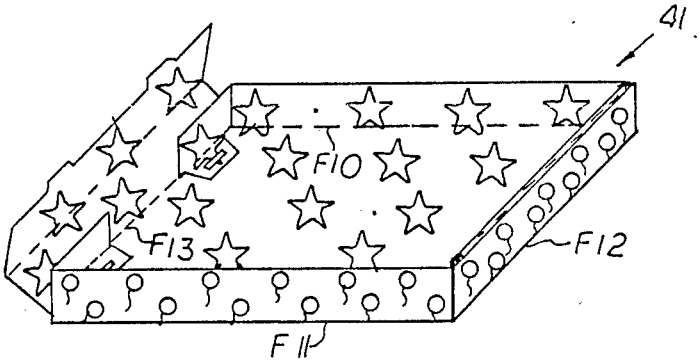
FIG. 6 is a perspective view of the blank of FIGS. 4 and 5 shown in a partially erected position.

FIGS. 4, 5 and 6 are directed to a blank construction from which a cover or closure 41 is formed to fit the container defined by the erection of blank 10 or 30. As shown in FIGS. 4 and 5, the cover blank 40 is formed of a single sheet of blank material having preformed foldlines to define a top cover panel 43 and connected marginal flap about which the marginal side and end flaps 41-41 and 42-42 are folded to define a circumscribing lip to fit over the sides and ends of the erected container in the assembled position. According to this invention, the exposed surfaces of the closure blank 40 are provided with a suitable indicia or pattern 40A and 40B arranged to complement or match the indicia formed on the container blank 10 or 10A. Like the container blank 10 or 10A, the cover blank is constructed so that the marginal flaps can be reversely folded so that the indicia 40A or 40B can be either on the external surface or internal surface of the erected cover. Thus, it will be apparent that the blanks herein described can be folded in a desired or selected manner whereby the user can mix or match the desired pattern formed on the respective container blank and cover blank, in the assembled position of the respective blanks.

It will be understood that the blanks can be scored or die cut in any suitable manner for facilitating the erection of the container body and/or closure therefor as long as the surface of the blank is provided with a predetermined pattern or indicia formed on the exposed surface thereof, and whereby the panels defined by the foldlines can be folded in either direction.

While the invention has been disclosed with respect to a parciular embodiment thereof, it will be understood and appreciated that variations and modifications may be made without departing from the spirit or scope of the invention.

What is claimed is:

1. A knock-down container and cover therefor for use as a utility domestic storage box for home use comprising a first generally rectangularly shaped blank of foldable sheet material having a first pair of spaced apart foldlines extending transversely across the entire width of said blank to define opposed side and connected inner end panels, and a second pair of spaced apart foldlines spaced intermediate the width of said blank and extending normal to and between said first pair of spaced apart foldlines to define therewith a bottom panel, opposed outer end panels connected to said bottom panel, a die cut extending from the opposed ends of said second pair of foldlines to the outer edge of said first blank to define said outer end panels, said die cut separating said outer end panel from the contiguous inner end panels connected to the adjacent side panel, whereby said side panels and inner end panels can be folded relative to said bottom panel to define a rectangular container in the erected position of said first blank, and said outer end panels being folded into overlying position relative to the contiguously folded inner end panels in the erected position of said container, means for interlocking said panels in the erected position of said container, indicia means disposed on both sides of said first blank, said indicia means defining a separate and different predetermined decorative and complementary pattern on each side of said first blank which are co-extensive in area to that of said first blank, and a second blank of generally rectangular shaped foldable sheet material, said second blank of sheet material having transverse foldlines to define a cover panel and connected side and end flaps which in the erected position of said second blank forms a cover for said container, said second blank having complementary indicia means defining a predetermined and different decorative pattern on each side of said second blank co-extensive in area to that of said second blank and similar to said decorative pattern on said first blank, each of said blanks being adapted to be reversely folded about its respective foldlines so that in their respective erected positions said container and closure therefor can be formed with mixed or matched indicia depending upon the direction in which the respective blanks are folded in erected said container and closure therefor.

2. A knock-down container and cover therefor for use as a utility domestic storage box for home use comprising a first blank of foldable sheet material having a first pair of spaced apart foldlines to define opposed side and connected end panels, and a second pair of spaced apart foldlines spaced intermediate the width of said blank and extending normal to and between said first pair of spaced apart foldlines to define therebetween a bottom panel, opposed outer end panels connected to said bottom panel, said outer end panels being separated from its contiguous inner end panels whereby said side panels and inner end panels can be folded relative to said bottom panel to define a rectangular container in the erected position of said first blank, and said outer end panels being folded into overlying position relative to the contiguously folded inner end panels in the erected position of said container, means for detachably interlocking said panels in the erected position of said container, indicia means disposed on both sides of said first blank, said indicia means defining a separate and different predetermined decorative and complementary pattern on each side of said first blank which are co-extensive in area to that of said first blank, and a second blank of foldable sheet material, said second blank of sheet material having transverse foldlines to define a cover panel and connected side and end flaps adapted to be oppositely folded relative to said cover panel to form a cover for said container in the erected position of said second blank, said second blank having complementary indicia means defining a predetermined and different decorative pattern on each side of said second blank co-extensive in area to that of said second blank, said indicia means on said first blank complementing said indicia on said second blank, each of said blanks being adapted to be reversely folded about its respective foldlines so that in their respective erected positions, said container and closure therefor can be formed with mixed and matched indicia depending upon the direction in which the respective blanks are folded in erecting said container and closure therefor.

* * * * *